United States Patent [19]

Marshall et al.

[11] 4,413,946

[45] Nov. 8, 1983

[54] VENTED COMPRESSOR INLET GUIDE

[75] Inventors: Dale F. Marshall, Allegany; Ted C. Evans, Olean, both of N.Y.

[73] Assignee: Dresser Industries, Inc., Dallas, Tex.

[21] Appl. No.: 294,592

[22] Filed: Aug. 20, 1981

[51] Int. Cl.[3] ..... F04B 15/00

[52] U.S. Cl. ..... 415/28; 415/11; 415/144

[58] Field of Search ..... 415/11, 17, 26, 27, 415/28, 49, 144; 308/207 R, 207 A; 60/39.24

[56] References Cited

U.S. PATENT DOCUMENTS

| | | | |
|---|---|---|---|
| 2,470,565 | 5/1945 | Loss | 415/27 |
| 2,839,071 | 6/1958 | Rosch | 415/49 |
| 3,009,631 | 11/1961 | Dimmock | 415/27 |
| 3,292,845 | 12/1966 | Hens et al. | 415/11 X |
| 3,327,932 | 6/1967 | Brodell | 415/28 |
| 3,487,993 | 1/1970 | Rannenberg | 415/28 |
| 3,688,504 | 9/1972 | Hutchinson et al. | 415/28 X |
| 3,727,400 | 4/1973 | Harrinson et al. | 415/28 X |
| 3,804,477 | 4/1974 | Allmandinger et al. | 308/207 A |
| 3,971,219 | 7/1976 | Taylor et al. | 415/17 X |
| 4,251,985 | 2/1981 | Sullivan | 415/27 X |

FOREIGN PATENT DOCUMENTS

| | | | |
|---|---|---|---|
| 54-153302 | 12/1979 | Japan | 415/28 |

*Primary Examiner*—Philip R. Coe
*Assistant Examiner*—Frankie L. Stinson
*Attorney, Agent, or Firm*—Daniel Rubin

[57] ABSTRACT

To provide reduction in temporary conditions of excess load on the thrust bearing, a labyrinth positioned contiguous to a leakage aperture in the high pressure side of a single stage overhung compressor rotor affords controlled leakage to a venting circuit in communication with a lower pressure system. A pressure switch responsive to pressure levels in the venting circuit prevents compressor start at pressures above the set point of the switch while a backpressure valve in the venting circuit when operative maintains a predetermined pressure level therein. When the thrust bearing is operating at speeds sufficient to enable acceptance of the load imposed by compressor pressure, an override solenoid valve serves to close the backpressure valve and operably shut the venting circuit.

7 Claims, 4 Drawing Figures

VENTED COMPRESSOR INLET GUIDE

TECHNICAL FIELD

The technical field to which the invention pertains comprises the art of compressors and operating controls therefor.

BACKGROUND OF THE INVENTION

A single stage compressor with an overhung rotor for process gas having one end of the compressor shaft exposed to atmosphere and the other end exposed to suction pressure can incur an extremely large thrust load on the shaft as a result of the imposed pressure differential. At low operating speeds, such as at startup or shutdown, the imposed loading is known to exceed the load factor for which the thrust bearing was selected. For that reason it has been necessary to improvise in order to allow low speed operation when excessive thrust load is being incurred.

A conventional approach toward resolving the foregoing has been to increase the load capacity of the bearing sufficient to withstand the load levels which the bearing incurs. This obviously represents a costly and unsatisfactory solution. Another approach has been to reduce the pressure differential by venting the process gas from the compressor to reduce the overall internal pressure to an acceptable level. This approach has likewise been unsatisfactory in that it has resulted in considerable wastage of process gas. Still another technique has been to counteract the high pressure differential with appropriately directed high pressure gas or oil at a pressure approximating the process gas. The latter tends to complicate and enlarge the seal oil system or require outside sources of high pressure gas.

As an expedient, each of the foregoing approaches has fulfilled the objective of maintaining thrust loads within tolerable limits. On the other hand, none has been regarded as satisfactory despite long-standing recognition of the problem.

SUMMARY OF THE INVENTION

This invention relates to compressors having an overhung rotor and more specifically to novel method and apparatus for reducing the thrust bearing load therefor during conditions of compressor operation in which thrust loads would exceed design limits of the thrust bearing. This is achieved in accordance with the invention by means of a controlled venting of the high pressure side selectively operable only under the extreme pressure conditions at which excessive bearing loads are incurred. Unlike the prior art in which venting techniques have resulted in wastage of large amounts of process gas, the invention hereof utilizes a restricted flow high pressure bleed communicating to atmosphere or a lower pressure system whereby the amount of vented gas is greatly reduced or eliminated.

A pressure switch and backpressure valve control opening and closing of the venting circuit. Included in the circuit is a labyrinth positioned opposite a slot opening in front of the impeller to provide controlled leakage through the slot when venting is intended. The backpressure valve functions to maintain a set pressure in the vent circuit and when the speed level of the compressor is sufficient to allow the full thrust load on the thrust bearing, the valve is closed to permit normal operation.

It is therefore an object of the invention to provide novel method and apparatus for controlled loading of a thrust bearing in a compressor having an overhung rotor.

It is a further object to provide apparatus for the previous object that is selectively operable only under conditions when excessive thrust loads would otherwise exist on the thrust bearing.

Figure 1:
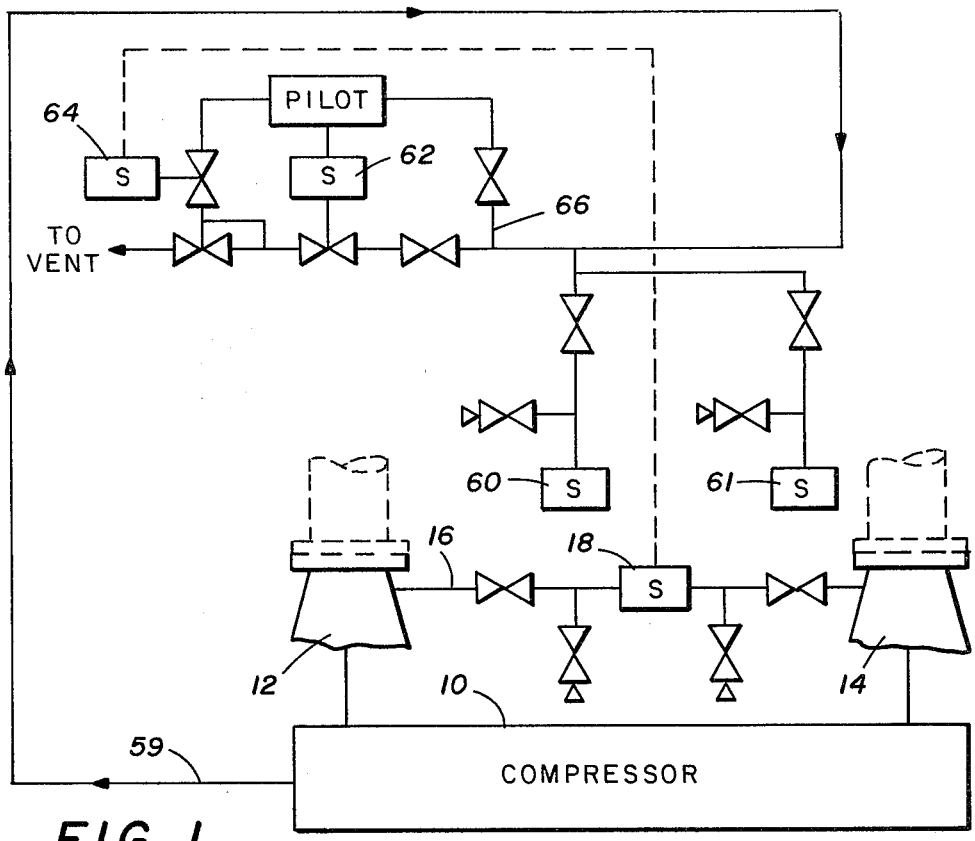
FIG. 1 is a schematic flow diagram for the bleed circuit of the invention.

Referring now to the drawings, there is illustrated in FIG. 1 a compressor 10 having a discharge nozzle 12 and a suction nozzle 14. Extending between the nozzles is a pressure conduit 16 containing a differential pressure switch 18 that is operable as will be explained below.

Figure 2:
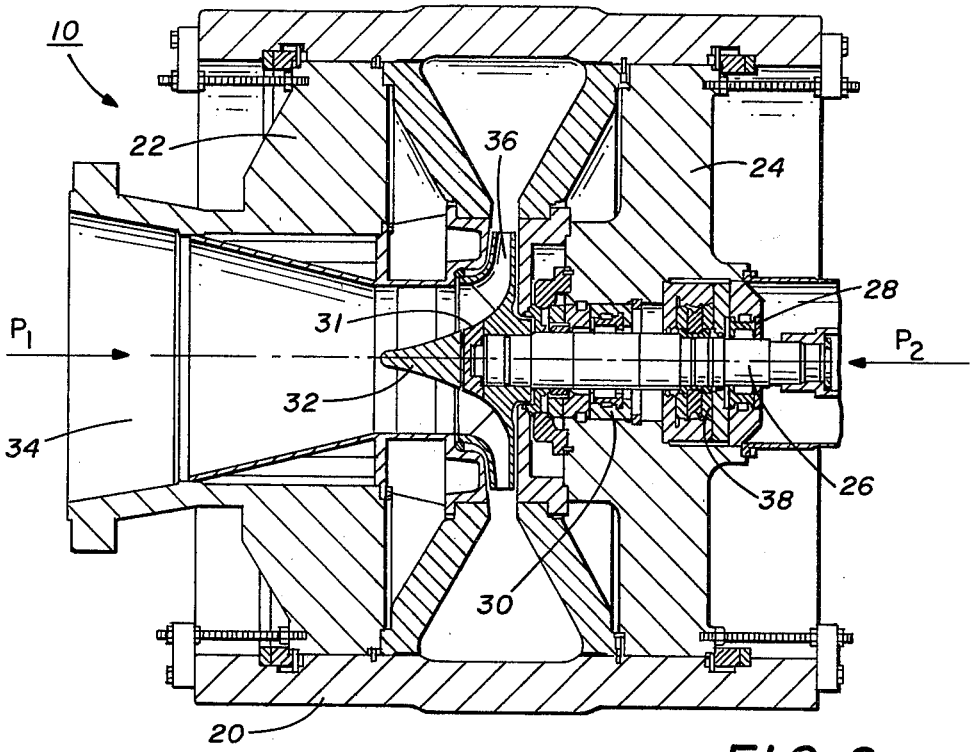
FIG. 2 is a cross section through a single stage overhung compressor.
Figure 3:
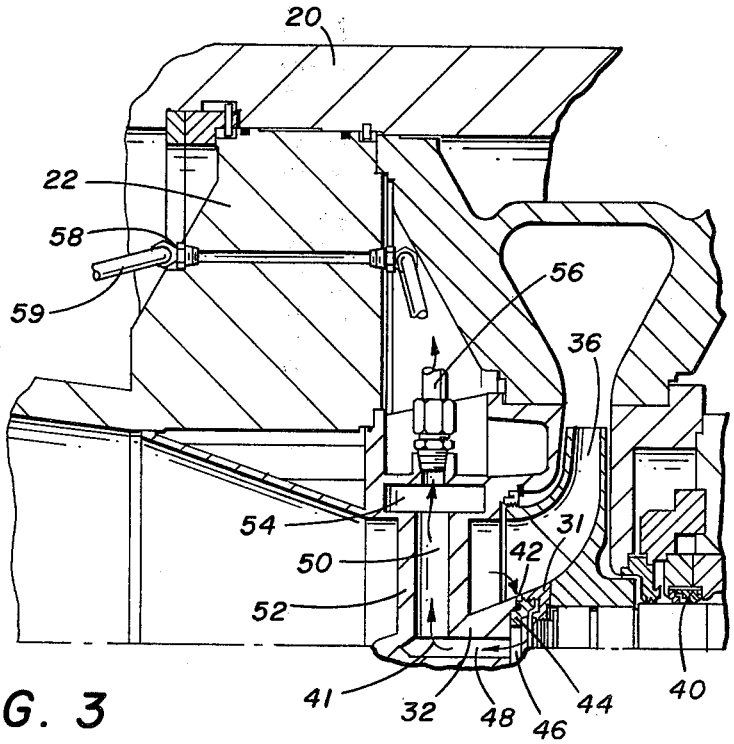
FIG. 3 is a fragmentary enlargement of a similar unit containing the venting apparatus of the invention.

Referring to FIGS. 2 and 3, compressor 10 comprises a casing 20 supporting spaced heads 22 and 24. Contained within head 24 is a shaft 26 mounted for rotation in bearings 28 and 30 and adapted to be rotatably driven by a driver (not shown) when coupled thereto. Adjacent the opposite end of shaft 26 is a stationary nose cone 32 providing flow communication at inlet 34. Impeller 36 is secured to the shaft along with shaft nut 31 for rotation therewith. During operation of the compressor a differential pressure created by suction pressure $P_1$ at inlet 34 and atmospheric pressure $P_2$ at the drive shaft end will produce an axial load on the shaft in a rightward direction as viewed in the drawings. For taking the thrust load imposed on shaft 26 by the foregoing pressure differential, there is provided a thrust bearing 38 of allowable load generally designed for the contemplated operating speed of the compressor.

Pressure $P_1$, depending on the compressor design and application, can typically vary up to approximately 1500 psia. It can therefore be appreciated that at whatever value of pressure exists at $P_1$ at a particular point in the operating cycle, the axial force imposed on thrust bearing 38 is equal to the pressure differential between $P_1$ and $P_2$ multiplied by the surface area 40 under the seal diameter, minus the pressure rise generated by impeller 36 times the impeller inlet area. At very low speeds, impeller generated thrust is negligible so that the thrust imposed by the pressure differential is entirely carried by the thrust bearing. At the same time the thrust bearing at low speeds has not yet formed a hydrodynamic oil film rendering its load capacity well below its capacity at design speeds. The need to therefore prevent bearing failure should be readily apparent.

Figure 4:
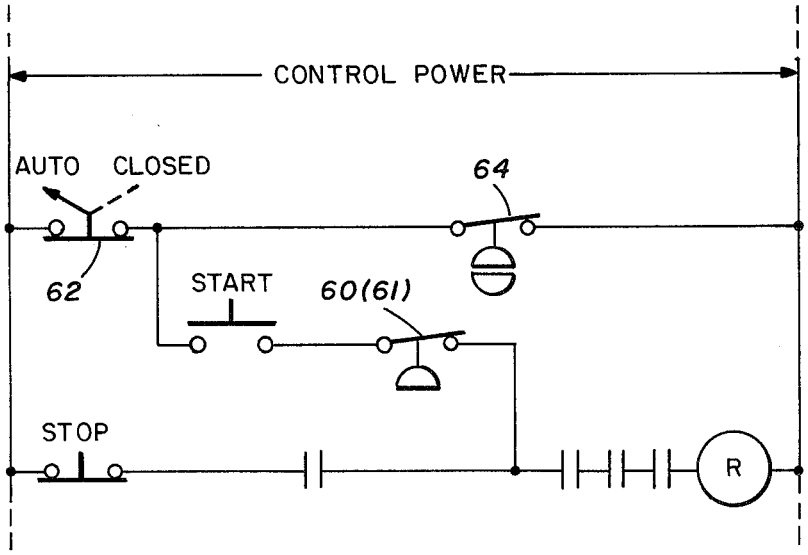
FIG. 4 is a schematic electrical circuit diagram for operating the venting circuit hereof.

In order to prevent overload of the thrust bearing from the startup pressure conditions, there is provided in accordance with the invention a venting circuit effective only during conditions of high pressure and low operating speed as will now be described with specific reference to FIGS. 1, 3 and 4. Venting in accordance herewith is achieved within the compressor via a flow path defined by arrows 41 beginning with an annular slot 42 between shaft end nut 31 and the nose cone 32. Positioned against nut 31 is an annular labyrinth seal 44 constructed with a tight clearance so as to guarantee a limited predetermined leakage therepast. Downstream of seal 44 leakage flow enters a cavity 46 inside nose cone 32 which in turn communicates with nose cone passage 48 opening into a passage 50 within inlet guide 52. An annulus 54 at the outlet of passage 50 communicates via tubing conduit 56 to exit hole 58 in the inlet head 22. Conduit 59, connected downstream of exit hole 58, transmits the venting leakage to a suitable vent or low pressure receiving source containing the same gas, at e.g. less than 150 psig. Operably positioned in conduit 59 are pressure switches 60 and 61 on the upstream side of a backpressure valve 62 and an override solenoid valve 64 located in a bypass 66.

In operation, any time the pressure level in line 59, as determined by pressure switches 60 and/or 61, is at or above a predetermined pressure setting corresponding to a $P_1$ at which excessive thrust load might be imposed on thrust bearing 38, compressor 10 is prevented from starting. Solenoid valve 64 operates when actuated by differential pressure switch 18 to activate and inactivate pilot operated backpressure regulator valve 62 in response to predetermined values of differential pressure between the compressor suction and discharge as an indication of compressor speed. With solenoid valve 64 open, the pilot operates regulating valve 62 to control line pressure at a predetermined safe level. When differential pressure switch 18 closes solenoid valve 64, the pilot automatically closes the regulating valve 62. Normally, backpressure regulator 62 would be closed any time bleed line pressure is below its set point, or if pressure switch 18 indicates high speed is attained as shown by a high $\Delta P$ level. On the other hand, regulator 62 will be open allowing flow to pass only if bleed line pressure is high enough to require regulation with differential pressure switch 18 showing a low $\Delta P$ level, indicating low speed operation.

Since some applications may require the inner chamber of inlet guide 52 to be maintained at a predetermined minimum pressure during compressor startup and shutdown, backpressure regulator 62 with override solenoid valve 64 is utilized to control the pressure during those portions of the operating cycle. Regulator valve 62 can likewise function during a shutdown cycle when decreasing compressor speed approaches a reduced predetermined minimum RPM. Solenoid valve 64 in this relationship serves when deenergized to permit complete closure of valve 62 while when energized will allow regulator valve 62 to open for regulation.

By the above description there is disclosed novel method and apparatus for venting the compressor inlet guide during conditions of high thrust load imposed on the thrust bearing supporting the compressor shaft. By means of an aperture communicating past a labyrinth seal, controlled venting of inlet gas flow through conduit is afforded under control of a pressure regulator to a lower pressure whenever existing pressure levels require that venting be utilized to prevent overload of the thrust bearing. After a pressure differential level is attained which can be accommodated by the thrust bearing the vent line is controllably shut so that the compressor can function in its normal manner without venting. By this limiting the amount of process gas to be vented, a portion of the energy contained therein and the commodity itself is retained and not lost in the manner of the prior art.

Since many changes could be made in the above construction, and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. In a centrifugal compressor having an overhung rotor including a shaft mounted for rotation, an impeller secured to said shaft for rotation therewith and a thrust bearing supporting said shaft against thrust loads imposed thereon, the improvement comprising apparatus for limiting the thrust load imposed against said rotor and comprising means in combination for controllably venting the low pressure side of the compressor exposed to said rotor and including:

(a) an aperture defined through a compressor wall from an inlet on the low pressure side of the compressor;

(b) labyrinth means for substantially sealing flow from said aperture to permit only a predetermined controlled leakage therepast;

(c) conduit means for communicating leakage from the outlet of said aperture to a relatively lower pressure receiving source; and (d) presettable control means operative at a set point correlated to the allowable thrust load design capacity of said thrust bearing and responsive to values of pressure in said conduit means to open and close said conduit means to leakage flow at pressure above and below the set point, respectively.

2. Apparatus according to claim 1 including override means operable to inactivate said control means for closing said conduit means at a predetermined minimum operating speed of the compressor.

3. Apparatus according to claim 2 in which said control means includes a backpressure regulator operable to maintain pressure in said conduit means below predetermined maximum pressure levels.

4. Apparatus according to claim 3 in which said override means includes sensing means operable to determine operating speed of the compressor and effective at high operating speeds to inactivate said backpressure regulator for closing said conduit means.

5. Apparatus according to claim 4 in which said sensing means comprises a differential pressure sensor operative in response to the differential in pressure between the suction and discharge pressure of the compressor.

6. Apparatus according to claim 5 in which said labyrinth means comprises a labyrinth seal positioned contiguous to the outlet of said aperture.

7. Apparatus according to claim 5 including second pressure sensor means responsive to pressure levels in said conduit means for preventing compressor startup when the pressure level in said conduit means is above a predetermined maximum level.

* * * * *